US006365028B1

(12) United States Patent
Shatrov

(10) Patent No.: US 6,365,028 B1
(45) Date of Patent: Apr. 2, 2002

(54) METHOD FOR PRODUCING HARD PROTECTION COATINGS ON ARTICLES MADE OF ALUMINUM ALLOYS

(75) Inventor: Alexandr Sergeevich Shatrov, Moscow (RU)

(73) Assignee: Isle Coat Limited (GB)

( * ) Notice: Subject to any disclaimer, the term of this patent is extended or adjusted under 35 U.S.C. 154(b) by 0 days.

(21) Appl. No.: 09/581,494

(22) PCT Filed: Dec. 17, 1997

(86) PCT No.: PCT/RU97/00408

§ 371 Date: Jun. 14, 2000

§ 102(e) Date: Jun. 14, 2000

(87) PCT Pub. No.: WO99/31303

PCT Pub. Date: Jun. 24, 1999

(51) Int. Cl.[7] ..... C25D 5/18

(52) U.S. Cl. ..... 205/102; 205/103; 205/106; 205/323; 205/326

(58) Field of Search ..... 205/102, 106, 205/107, 108, 103, 323, 324, 325, 326; 204/DIG. 9

(56) References Cited

U.S. PATENT DOCUMENTS

| | | | | |
|---|---|---|---|---|
| 5,066,368 A | * | 11/1991 | Pasqualoni et al. | 205/112 |
| 5,275,713 A | | 1/1994 | Hradcovsky | 205/106 |

FOREIGN PATENT DOCUMENTS

| | | |
|---|---|---|
| RU | 1200591 | 4/1989 |
| RU | 1713990 | 2/1992 |
| RU | 94023296 | 10/1996 |
| RU | 2070622 | 12/1996 |
| RU | 2070947 | 12/1996 |
| WO | WO9518250 | 7/1995 |

* cited by examiner

*Primary Examiner*—Kathryn Gorgos
*Assistant Examiner*—Wesley A. Nicolas
(74) *Attorney, Agent, or Firm*—Sheridan Ross P.C.

(57) ABSTRACT

This invention relates to the sphere of plasma electrolyte oxide coating of aluminium alloys. The method incorporates anode-cathode oxide coating in an alkaline electrolyte at a temperature of 15–50° C., using 50–60 Hz frequency alternating current. In the initial stage of the process oxide coating is carried on for 5–90 seconds at a current density of 160–180 A/dm$^2$, then the current density is dropped to 3–30 A/dm$^2$ and the process is continued in a regimen of spontaneous diminution of power demand without on-line adjustment of the regimen until the set coating thickness is achieved. The alkaline electrolyte used is an aqueous solution of alkaline metal hydroxide at 1–5 g/l, an alkaline metal silicate at 2–15 g/l, an alkaline metal pyrophosphate at 2–20 g/l and peroxide compounds at 2–7 g/l (in terms of $H_2O_2$—30%). The method enables the protective properties of ceramic oxide coatings to be enhanced through an increase in the micro-hardness, density and strength of adhesion to the substrate without any additional energy outlay or time required.

4 Claims, 1 Drawing Sheet

METHOD FOR PRODUCING HARD PROTECTION COATINGS ON ARTICLES MADE OF ALUMINUM ALLOYS

AREA OF TECHNOLOGY

This invention relates to processes for applying protective oxide coatings to items made from aluminium alloys, and more specifically, to a method of plasma electrolytic oxide coating of the surfaces of items. The invention may be used in engineering, equipment-building and other areas of industry.

Because of their physical and mechanical properties and the process used to manufacture items of complex configuration, aluminium alloys (both wrought and castable) are increasingly being used in the manufacture of important and rapidly-wearing parts of machines. There is therefore an urgent need for protective coatings to be produced thereon which are resistant to wear when exposed to abrasive particles and high local temperatures, and are unaffected by corrosive environments. One way of dealing with this problem is to apply ceramic-oxide corundum coatings to aluminium alloys using a method of plasma electrolytic oxide coating. Of crucial importance for long-term operation of items with such a coating is the thickness, micro-hardness and strength of adhesion to the substrate of the coating, while for the method to be assimilated in practice, the process needs to have a high output and be reliable, the equipment should be simple and the way it is run should present no hazard to the environment.

PRIOR ART

A method is known for oxidising aluminium alloys (DE, A1, 4209733) in an anode-cathode regimen with a current density of 2–20 A/dm$^2$ and final voltage amplitudes of: anode—300–750 V; cathode—15–350 V. The pulse frequency may vary from 10 to 150 Hz, with the anode current pulse duration 10–15 ms and the cathode current pulse duration 5 ms. The method enables dense solid oxide coatings 50–250 microns thick to be applied using an alkaline-silicate or alkaline-aluminate electrolyte.

This method has the following drawbacks: low process output, high energy consumption and complex equipment requirement In addition, use of the traditional alkaline-silicate electrolyte does not ensure that a consistent quality coating is produced on the items. Long-term use of the electrolyte leads to changes in the characteristics of the coatings applied, with a deterioration in the quality and a diminution in the thickness thereof. Electrolyte stability lies within 30–90 Ah/l, and is not capable of being adjusted during the operating process.

A method of obtaining solid, ceramic-oxide coatings of low porosity and with good adhesion to the substrate, 100 microns or more in thickness, on aluminium alloys is known (U.S. Pat. No. 5,616,229). Shaping of the layer takes place in an anode-cathode regimen in sequence in several baths containing an alkaline-silicate electrolyte. Of these baths, the first contains only a 0.5 g/l aqueous KOH solution; the second contains an aqueous solution of 0.5 g/l KOH and 4 g/l sodium tetrasilicate; and the third contains an aqueous solution of 0.5 g/l KOH and 11 g/l sodium tetrasilicate. The main drawback to this known method is the use of a traditional unstable electrolyte, coupled with the complex equipment design and apparatus layout.

Another method is known by which wear-resistant ceramic-oxide coatings may be applied to aluminium alloys (U.S. Pat. No. 5,385,662), 50–150 microns in thickness, using plasma-chemical anode oxide coating with a current density of over 5 A/dm$^2$ and at an electrolyte temperature of up to 15° C. A very narrow temperature fluctuation range of ±2° C. is allowed. The electrolyte consists of an aqueous solution of sodium phosphate and borate, and also contains ammonium fluoride; the total salts concentration in the solution should not exceed 2 M/l. Use of this electrolyte does not enable a coating with a high micro-hardness rating to be obtained on aluminium alloys (no more than 7.5 GPa). This is also indicated by the low value of the final anode voltage (just 250 V). The electrolyte also contains harmful fluorides, which necessitates expenditure to dispose of these. To obtain coatings with a high level of hardness (up to 20 GPa), the electrolyte described above may, it is proposed, be diluted by 100 times with water and 0.1 M sodium aluminate and 0.1 M sodium silicate added (the pH of such a solution is 10–12). Again, the main drawback to this method is the lack of stability of the aluminosilicate electrolyte. Sodium aluminate is also poorly soluble in water, which gives rise to an oxide coating that is uneven over the thickness of the coating, and to the formation of deposits on the walls of the stainless steel bath that are difficult to remove.

A method is known for applying solid corrosion-resistant coatings to items made of aluminium and its alloys (U.S. Pat. No. 5,275,713) in an aqueous electrolyte solution containing an alkaline metal silicate, hydrogen peroxide and small quantities of hydrogen fluoride, alkaline metal hydroxide and a metal oxide (for example, molybdenum oxide). The solution has a pH of 11.2–11.8. A positive potential is delivered to the item from a direct or pulsed current source. For the first 1–60 s the voltage is raised to 240–260 V, and over the next 1–20 minutes (depending on the required coating thickness) it is steadily increased to 380–420 V. The introduction of hydrogen peroxide as an oxygen accumulator into the electrolyte helps to raise the rate of increase of the oxide coating and its hardness through intensification of oxide coating of the metal in the spark discharge zone.

A drawback to this method, however, is the fluorides and heavy metal salts content in the electrolyte. The heavy metal salts also have a harmful impact on the stability and duration of use of the electrolyte, since heavy metal ions are catalysts and significantly accelerate the breakdown of hydrogen peroxide in solution. Moreover, the "voltage surge" achieved in the first few seconds of the process, while enabling the pre-spark oxide coating period to be somewhat curtailed, has virtually no impact on the properties of the coating, since it is done at relatively low current densities (not above 15 A/dm$^2$). This method is used to apply tin oxide films (up to 30 microns) which always have good adhesion to the substrate.

The method that is most similar to the proposed invention is one in which solid ceramic-oxide coatings are applied to items made of aluminum alloys by plasma electrolytic oxide coating (RU, C1, 2070622) in a pulse anode and/or anode-cathode regimen using commercial-frequency current An environmentally clean electrolyte is used, comprising an aqueous solution of an alkaline metal hydroxide, a silicate and an alkaline metal pyrophosphate. The $P_2O_7^{-4}$ pyrophosphate ions stabilise the colloidal silicate solution, and play an active part both in the plasmochemical synthesis of oxides in the spark breakdown channels, and in the processes of electrochemical polycondensation of anion complexes of the electrolyte on the spark-free surface. The electrolyte features a high level of stability (up to 400 A·h/l) and the capacity to be adjusted while in use. A drawback of the known method is the relatively low rate of formation of the oxide coating and the high level of energy consumption of the process.

DISCLOSURE OF SUBSTANCE OF INVENTION

The main aim of this invention is to improve the quality of the ceramic-oxide coating through an increase in the strength of adhesion to the substrate and in the microhardness of the coating. Another aim of the invention is to increase the rate of formation of the oxide coating through intensification of the plasmochemical synthesis reactions without increasing the energy consumption of the process. A further aim of the process is to ensure that quality oxide coatings are obtained over a relatively lengthy period of time through use of an electrolyte with a high level of stability and the capacity to be adjusted during use. Yet another aim of the invention is to reduce the cost of running the oxide coating process through the use of simple and reliable equipment with the minimum essential apparatus layout and an environmentally clean electrolyte comprising inexpensive and plentiful components.

The aims described are achieved by performing oxide coating of aluminium alloys in an alkaline electrolyte at a temperature of 15–50° C. in an anode-cathode regimen using 50–60 Hz alternating current In the initial stage of the process, oxide coating is carried out for 5–90 seconds at a current density of 160–180 A/dm$^2$, then the current density is dropped to an optimal 3–30 A/dm$^2$ and the main established process of oxide coating is carried on in a regimen of spontaneous reduction of power consumption until a coating of the required thickness has been produced. The alkaline electrolyte is an aqueous solution of an alkaline metal hydroxide at 1–5 g/l, an alkaline metal silicate at 2–15 g/l, an alkaline metal pyrophosphate at 2–20 g/l and peroxide compounds at 2–7 g/l (in terms of $H_2O_2$—30%).

The spontaneous power reduction regimen is one where the initial polarising current level is set, following which there is no on-line adjustment of current parameters up to the end of the oxide coating process. Since the electrical resistance rises with the growth of the coating, a progressively larger potential difference between the electrodes is needed for consecutive spark discharges. The number of spark discharges on the surface being oxidised gradually diminishes, but they become more powerful and "burn" for longer. Thus in a diminishing power regimen there is a smooth and spontaneous increase in voltage and fall in current magnitude, while the power expended on oxide coating is 30–40% less at the end of the regimen than at the The main drawback to the known methods of oxide coating (DE, A1, 4209733; U.S. Pat. No. 5,385,662; RU, C1, 2070622) is the long time required to attain the sparking regimen, which in turn increases the duration of the entire coating formation process. The attainment of a sparking regimen is particularly onerous and technically complex for oxide coating of silicon-containing aluminium alloys.

The oxide coating time may not be shortened by raising the electrical parameters of the electrolysis, for example the current density (above 30 A/dm$^2$), because of a deterioration in the quality of the coating and a steep rise in the energy consumption of the process. The time of transition from the anodising stage to the spark discharge stage, however, depends on the initial current density.

Besides the method referred to above (U.S. Pat. No. 5,275,713), attempts to begin the oxide coating process with a high current density were also undertaken previously (SU, A1, 1398472). However, in all the known cases an anode process was used, in other words a direct or pulse current of positive polarisation was fed to the electrodes.

Practice has shown, however, that anode oxide coating processes often retard the formation of hydroxide phases (boehmite, bayerite).

The pause between pulses in the anode spark process is sometimes of insufficient duration to shift the spark discharges onto new, cold areas of the surface. The discharges occur where they have just expired Meanwhile in the areas where no discharges have occurred for a long time, there occurs shaping of the bottom of the hydroxide phase pores in a normal chemical oxide coating regimen. The dielectric strength in these places is very high, and it is even possible for there to be instances of the oxide coating process gradually coming to a stop, despite a substantial increase in anode voltage.

The hydroxide phases, however, possess rectifying properties. Consequently the imposition of pulses of negative polarity (anodecathode process) causes breakdowns at places where the coating is unipolar in nature. The anode discharge following a cathode discharge begins at a high oxide layer permeability. Thus with alternating current polarisation of an aluminium alloy electrode, a dense oxide coating of even thickness is formed thereon.

The technical design proposed in the method for which the application is being made involves delivering heteropolar pulses to the electrode both at the initial stage of the process at a high current density, and also in an established regimen at an optimal current density, which is substantially different to the known methods.

The positive effect is obtained by the occurrence of powerful micro-arc discharges at the high current density values in the initial period of oxide coating, which provide intensive mixing of the substrate metal and the oxide films. This increases the mutual diffusion of the substrate substance and the coating and helps to increase the strength of their adhesion. Analysis of the boundary between substrate and coating shows a blurred adhesion zone, indicating the formation of an enlarged diffusion zone. During such a short time interval the non-productive electric energy consumption is minimal, and the electrolyte temperature in the bath changes very little.

The time taken to attain the established sparking regimen, and consequently also the overall oxide coating time, are reduced by 10–25%.

The threshold current density and oxide coating process duration values have been verified experimentally. The current density in the initial stage of 160–180 A/dm$^2$ was determined from the condition of the maximum rate of oxide coating of aluminium with selected electrolyte composition. The duration of the initial stage is selected specifically for each alloy, but increasing the time above 90 seconds does not bring about any perceptible changes in the quality of the coating, though it does cause higher electricity consumption.

To obtain even oxide coatings, especially on items of complex shapes, at the established stage of the oxide coating process it helps to alternate an anode-cathode process with a cathode process, in which only cathode pulses are delivered to the item and there is additional activation of the surface being coated. In this case the power source is equipped with a unit for regimen cycling which sequentially switches in and out the anode-cathode or cathode regimen for set durations. The duration of delivery of anode-cathode pulses is 5–30 seconds, and the duration of delivery of cathode pulses is 1–10 seconds. The current density of the cathode pulses during the cathode regimen is 5–25% of the current density during the anode-cathode regimen. The alternation of anodeathode and cathode regimens helps to produce denser and less porous coatings of even thickness.

Examples of the shape of the pulses of the process current and their sequence in time with the different electrolysis regimens are illustrated in graph form in FIGS. 1–4.

Figure 1:
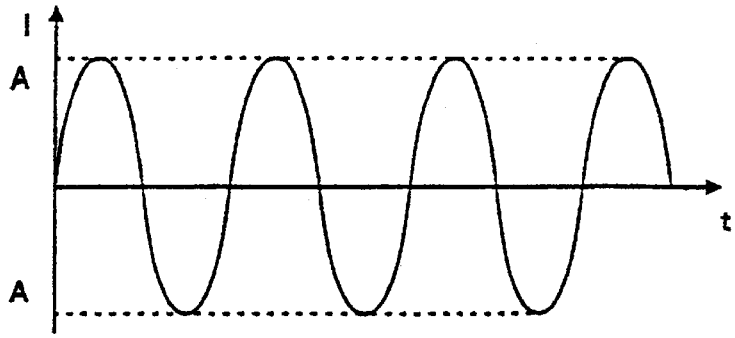
FIG. 1 illustrates the current shape in an anode-cathode regimen, when the polarisation is obtained through an alternating sinusoidal current.
Figure 2:
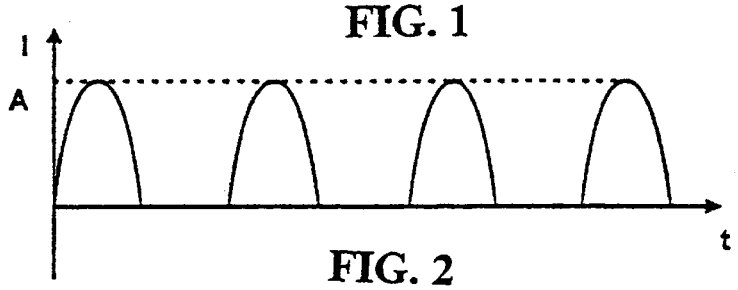
FIG. 2 illustrates the current shape in an anode regimen when the polarisation is obtained solely through an anode current.
Figure 3:
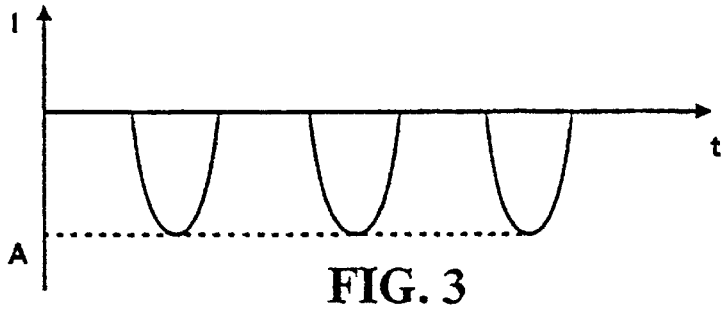
FIG. 3 illustrates the current shape in a cathode regimen when the polarisation is obtained solely through a cathode current.
Figure 4:
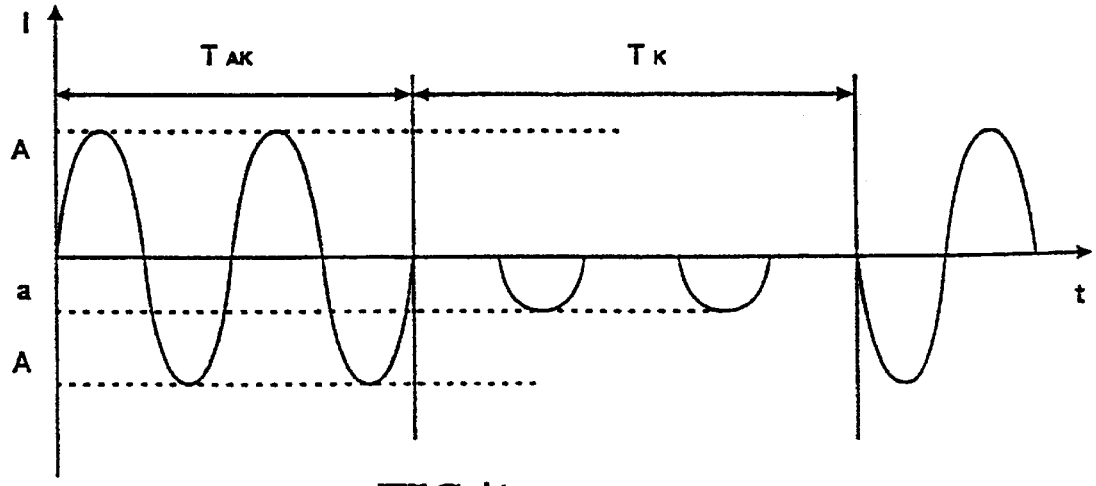
FIG. 4 illustrates the current shape m an anode-cathode regimen with cathodisation, when an alternation (with set periods) is carried out between alternating current polarisation and purely cathodic amplitude-asymmetrical polarisation, where.

| | |
|---|---|
| A - | current amplitude in anode-cathode period; |
| a - | current amplitude in cathode regimen (cathodisation); |
| a = | 0.05–0.25; |
| $T_{ac}$ - | duration of anode-cathode period, $T_{ac}$ = 5–30 s; |
| $T_c$ - | duration of cathode period, $T_c$ = 1–10 s. |

Attempts to use peroxide compounds in electrolytes as a source of chemically-bonded oxygen have been made by several researchers (U.S. Pat. No. 5,275,713; U.S. Pat. No. 5,069,763; SU, A1, 1767094). The problems here have been in the instability of the solutions, since the intensity of breakdown of the peroxide compounds rises under the influence of alkalis, heat, light and so on.

According to this invention, the addition of peroxide compounds to the composition of a known electrolyte gives the new composition new properties. The alkaline metal pyrophosphate (to a greater extent) and the alkaline metal silicate (to a lesser extent) that are present in the composition of the electrolyte are excellent hydrogen-peroxide-based oxidant stabilisers.

Despite the fact that pyrophosphates give solutions with a higher pH than other phosphates, for example $Na_2HPO_4$, the $H_2O_2$ stabilisation effect is much more strongly manifested in them. When prepared electrolyte is kept for 10 days, no breakdown of $H_2O_2$ occurs. This enables the new electrolyte composition to be utilised in industrial production.

The introduction of peroxide compounds into an alkaline pyrophosphate-silicate electrolyte has a positive impact both on the electrolysis process and on the quality of the coating formed.

Hydrogen peroxide is simultaneously a source of free OH radicals and of oxygen. Diffusion of oxygen moving out of the electrolyte towards the surface of the electrode with dissociation of $H_2O_2$ leads to intensification of thermo-chemical plasma reactions on the surface of the item being coated. The rate of oxide layer formation is increased by 10–25%. The micro-hardness of the coating is also increased through a rise in the aluminium oxide content in the phase composition of its high-temperature alpha phase.

The specific nature of the oxide coating process in the new electrolyte is, moreover, associated with an increased capture of free electrons in the solution by the peroxide anion and, consequently, with an increase in the energy of the positive ions coming into the solution from the discharge. The result of this effect is a more intensive polymerisation of pyrophosphate and silicate. Initiation of polymerisation and polycondensate chains in the solution leads to intensive formation of insulating layers on the electrode, which causes an increase in the breakdown voltage, and this in turn leads to a rise in the micro-hardness of the coating.

Finally, systems of various inorganic polymers and oxides of aluminium are formed with mutably penetrating and mutually reacting structures, which makes the coating elastic and resistant to vibration and impact loads.

The threshold values of component concentrations in the electrolyte composition are determined experimentally. At component concentrations below the threshold values indicated, the oxide coating process continues at high current densities, and the coatings that are obtained are uneven, with enhanced porosity around the edges of the item. A rise in the component concentration above the threshold values causes thick, brittle and inelastic coatings to be obtained.

Among the peroxide compounds which may be utilised are hydrogen peroxide and/or alkaline metal peroxides ($Na_2O_2$, $K_2O_2$, $Li_2O_2$), or alkane metal peroxo-solvates (peroxophosphate, peroxocarbonate, peroxoborate and so on).

The invention is illustrated by the example given below and in the table. A 200 mm diameter disc of D16 alloy ($AlCu_4Mg_2$), 20 mm deep, machined to the set size, was subjected to oxide coating (surface to be coated 7.5 $dm^2$). The item was immersed on a current supply into a 600 litre bath which was a counter-electrode, and a compressor was switched on to bubble air through the electrolyte. The electrolyte used was based on distilled water with 2 g/l caustic potash, 3 g/l sodium silicate glass, 4 g/l sodium pyrophosphate and 3 g/l hydrogen peroxide (30%). With the aid of a 125 kW power source, positive and negative voltage pulses (anode-cathode regimen) were delivered in an alternating sequence to the item and the bath at 50 Hz frequency. During the first 10 seconds, oxide coating was carried on at a current density of 160 $A/dm^2$, then the current density was lowered to 10 $A/dm^2$ and oxide coating was continued without any further interference until a coating thickness of 130 microns was achieved. The current density at the end of the process was 6 $A/dm^2$. The electrolyte temperature was maintained in the 35–45° C. range. After oxide coating, the items were washed in warm water and dried at 80° C.

In the oxide coating process, the average current in the circuit and the amplitude values of the anode and cathode components of the power voltage were monitored. The instantaneous current and voltage values were recorded using an oscillograph. The strength of the adhesion between the oxide coating and the metal was determined using a pin method (calculated as the ratio of the detachment force to the area of damaged coating). The micro-hardness was measured on taper micro-sections (calculated as the arithmetic mean value after 10 measurements at different oxide layer depths).

The table gives a comparison of the electrolysis regimens and the coating characteristics obtained on items of $AlCu_4Mg_2$ alloy using the known methods and the proposed method.

As may be seen from the table, the proposed method provides the following technical and economic benefits: wear-resistant coatings of comparable thickness are formed 1.1–1.25 times more quickly without increasing the electricity consumption. At the same time the micro-hardness of the coating is increased by 15% on average, and the strength of adhesion to the substrate material rises by 15–20%.

The proposed method thus, enables ceramic-oxide coatings with good protective and physical/mechanical properties to be obtained reliably on aluminium alloys. The coatings have a high micro-hardness and high strength of adhesion to the substrate metal, which virtually precludes delamination during use.

The electrolyte used in the proposed method features exceptional stability and presents no environmental hazard. It contains no chlorides, fluorides, ammonia or heavy metal salts.

The method is put into effect on simple and reliable process equipment using commercial frequency alternating current, with minimal operating costs.

COMMERCIAL APPLICABILITY

The proposed method may suitably be used to apply wear-resistant coatings to aluminium alloy items operating in environments where abrasive and corrosive factors are present, for example, pistons and cylinder liners of internal combustion engines, pump and compressor parts, hydraulic and pneumatic equipment parts, plain bearings, stop and control valves, radiators, heat exchangers, etc.

TABLE

| Electrolyte composition, electrolysis regimens, coating and oxide coating process characteristics | Known method (DE 4209733) | Known method (RU 2070622) | Proposed method |
|---|---|---|---|
| 1. Electrolyte composition: | | | |
| Potassium hydroxide, g/l | 2 | 1 | 2 |
| Sodium silicate, g/1 | 9 | 2 | 3 |
| Sodium pyrophosphate, g/l | — | 3 | 4 |
| Hydrogen peroxide, (30%) ml/l | — | — | 3 |
| Distilled water, 1 | <1 | <1 | <1 |
| 2. Coating formation regimens: | | | |
| Anode voltage amplitude at end of process, V | 690 | 720 | 780 |
| Cathode voltage amplitude at end of process, V | 300 | 350 | 320 |
| Current density (anode and cathode), A/dm$^2$ | | | |
| in initial stage | — | — | 160 |
| in established stage | 6 | 8 | 106 |
| Electrolyte temperature, ° C. | 30 | 40 | 40 |
| Oxide coating time, min. | 180 | 150 | 135 |
| 3. Coating characteristics: | | | |
| Oxide coating thickness, microns | 100 | 130 | 130 |
| Micro-hardness, Gpa | 16.0 | 16.4 | 18.6 |
| Strength of adhesion to substrate, Mpa | 297 | 309 | 358 |
| 4. Process characteristics: | | | |
| Per unit energy demand, KWh.dm$^{-2}$/micron | 0.090 | 0.085 | 0.080 |
| Electrolyte stability, A.h/l | 30–90 | 180–400 | 150–300 |

What is claimed is:

1. A method of obtaining protective coatings on aluminium alloy items, the method including an anode-cathode oxide coating process in an alkaline electrolyte at a temperature of 15–50° C., using 50–60 Hz alternating current, characterised in that in an initial stage of the process, oxide coating is carried out for 5–90 seconds at a current density of 160–180 A/dm$^2$, the current density is then reduced to 3–30 A/dm$^2$ and the process is continued in a regimen of progressively diminishing power demand until a coating of a required thickness is obtained.

2. A method according to claim 1, wherein oxide coating in a diminishing power demand regimen is carried out with alternation of anode-cathode and cathode regimens, a duration of delivery of anode-cathode pulses being 5–30 seconds and a duration of delivery of cathode pulses being 1–10 seconds, and wherein a current density of the cathode pulses in the cathode regimen is 5–25% of a current density of the anode and cathode pulses in the anode-cathode regimen.

3. A method according to claim 1 or 2, wherein the electrolyte is an aqueous solution of alkaline metal hydroxide at 1–5 g/l, an alkaline metal silicate at 2–15 g/l, an alkaline metal pyrophosphate at 2–20 g/l and peroxide compounds at 2–7 g/l (in terms of $H_2O_2$—30%).

4. A method according to claim 3, wherein the peroxide compounds are hydrogen peroxide and/or alkaline metal peroxides or alkaline metal peroxo-solvates.

* * * * *